US005485710A

United States Patent [19]

Lafond

[11] Patent Number: 5,485,710

[45] Date of Patent: Jan. 23, 1996

[54] INSULATED GLASS SPACER WITH DIAGONAL SUPPORT

[76] Inventor: Luc Lafond, 23 Woodvalley Drive, Etobicoke, Ontario M9A 4H4, Canada

[21] Appl. No.: 224,416

[22] Filed: Apr. 8, 1994

[51] Int. Cl.[6] ..... E06B 7/12

[52] U.S. Cl. ..... 52/204.593; 52/172; 52/786.13

[58] Field of Search ..... 52/171, 172, 790, 52/788, 789; 428/34

[56] References Cited

U.S. PATENT DOCUMENTS

| | | | |
|---|---|---|---|
| 3,027,608 | 4/1962 | Ryan . | |
| 4,222,213 | 9/1980 | Kessler | 52/172 X |
| 4,335,166 | 6/1982 | Lizardo et al. . | |
| 4,658,553 | 4/1987 | Shinagawa . | |
| 4,719,728 | 1/1988 | Eriksson et al. . | |
| 4,835,926 | 6/1989 | King . | |
| 4,994,309 | 2/1991 | Reichert et al. | 428/34 |
| 5,094,055 | 3/1992 | Berdan | 52/790 X |
| 5,377,473 | 1/1995 | Narayan et al. | 52/790 |

FOREIGN PATENT DOCUMENTS 2420014 12/1979 France .

*Primary Examiner*—Carl D. Friedman
*Assistant Examiner*—Kien T. Nguyen
*Attorney, Agent, or Firm*—McFadden, Fincham

[57] ABSTRACT

An insulated spacer and assembly incorporating the same. The spacer includes a plurality of individual and enclosed hollow areas surrounded by the spacer body. The individual areas are of a general trigonal shape and may include loose or consolidated desiccant material therein. The spacer has been found to provide effective thermal efficiency and has substantially reduced thermal bridging conventionally attributed to spacers when used in insulated glass assemblies.

11 Claims, 1 Drawing Sheet

INSULATED GLASS SPACER WITH DIAGONAL SUPPORT

FIELD OF THE INVENTION

The present invention relates to an insulated glass spacer body and more particularly, the present invention relates to a spacer and its incorporation in an insulated glass assembly for providing an energy efficient spacer and insulated glass assembly.

BACKGROUND OF THE INVENTION

Generally speaking, the insulated glass assembly art is a well developed art as is the spacer art. The use of various plastics for fabricating the spacers in such insulated glass assemblies has been the subject of many patents, typical of which is U.S. Pat. No. 4,658,553, issued Apr. 21, 1987 to Shinagawa. The reference discloses the use of a resinous material for spacing glass sheets in a refrigerated display case. Although this reference discloses the use of a resinous material for use in the fabrication of the spacer, from a structural point of view the surface area contact of the spacer on the glass substrates is at a maximum and additionally the front portion of the spacer in contact with the internal atmosphere of the assembly extends between and contacts each of the substrates. Further still, the spacer in the Shinagawa reference provides a large internal volume within the spacer. Based on these elements, it would appear to be susceptible to energy transfer from one substrate to the other, based on the structure of this spacer.

Eriksson et al., in U.S. Pat. No. 4,719,728, issued Jan. 19, 1988, disclose a collapsible spacer member. Collapsibility of the spacer is achieved by the use of notches in the body at the corners and mediaily of two sides. The two sides contact each of the substrates. Although this arrangement is useful to some extent, it would appear to be quite limited in terms of the ability of the same to function effectively from an energy conservation point of view. It would appear that energy transfer may be pronounced at the areas where the notches are since the same reduce the thickness of the body of the spacer.

U.S. Pat. No. 4,335,166, issued Jun. 15, 1982, to Lizardo et al., teaches a method of manufacturing a multi-pane insulating glass unit. The spacer employed in this arrangement is indicated to comprise a roll formed plastic spacer. Similar to the Shinagawa reference discussed hereinabove, this reference additionally provides a spacer body having a relatively large internal volume as well as a support member contacting the internal atmosphere of the assembly which extends between and contacts each of the panes. The support member may act as a thermal bridge from one substrate to the other similar to the difficulty previously encountered with metal spacers although to a somewhat more limited degree due to the incorporation of plastics in the spacer.

It is evident that there is a need in the spacer and insulated glass assembly art for an improved spacer which substantially reduces thermal transfer between the substrates and subsequently which reduces heat loss at the perimeter of the insulated assembly. The present invention is directed to providing a solution to the problem of energy efficiency in the insulated glass assembly art.

SUMMARY OF THE INVENTION

One object of the present invention is to provide an improved spacer for use in insulated glass assemblies.

A further object of the present invention is to provide a spacer for spacing glass substrates in an insulated glass assembly comprising: an integral plastic C-shaped body having a pair of arms, each arm of the pair for engaging a substrate; a base connected to and extending between the arm; a plurality of hollow trigonal spaces within and surrounded by the body; and a plurality of partitioning members integral with the C-shaped body for defining the plurality of trigonal spaces.

The structure of the spacer body has been found to provide adequate strength for supporting substrates engaged therewith while at the same time provided an extremely effective energy efficient arrangement.

The provision of the partitioning members additionally provide a support feature and may be connected together and spaced from a base portion of the strip or, alternatively, connected to the base.

Generally speaking, the individual and spaced trigonal areas are particularly energetically favorable since those trigonal areas, having a common side adjacent a substrate, effectively keep the cooler air therein and thus prevent a pronounced temperature gradient at the edge of the insulated assembly.

A further object of the present invention provides an insulated glass assembly comprising: a pair of glass substrates; a integral C-shaped plastic body having a pair of arms, each arm of the pair engaged with a substrate; a base connected to and extending between the arms; a plurality of hollow trigonal spaces within and surrounded by the body; and a plurality of partitioning members integral with the C-shaped body for defining the trigonal spaces.

A still further object of the present invention provides a spacer for spacing glass substrates in an insulated glass assembly comprising: an integral plastic C-shaped body having a pair of arms, each arm of the pair for engaging a substrate; a base connected to and extending between the arms; a convergent support member extending inwardly of said C-shaped body and between the arms for supporting the arms, the convergent support member converging towards the base.

Having thus generally described the invention, reference will now be made to the accompanying drawings, illustrating preferred embodiments.

DETAILED DESCRIPTION OF THE PREFERRED EMBODIMENTS

Figure 1:
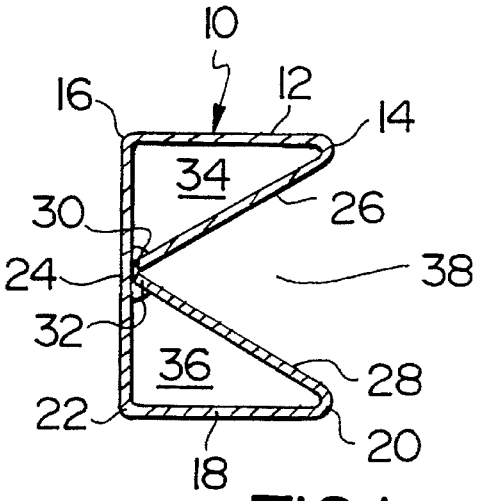
FIG. 1 is a side elevational view of one embodiment of the spacer according to the present invention.

Referring now to the drawings, FIG. 1, numeral 10 denotes one embodiment of the spacer according to the present invention. In the Example, the spacer comprises a continuous body having a first arm 12 with a forward end 14 and a rearward end 16 and a second arm 18 having a forward end 20 and a rearward end 22, the arms 12 and 18 being in spaced relation and joined at ends 16 and 22, respectively, by a connecting arm 24.

Each arm 12 and 18 includes a support and partitioning member 26 and 28, respectively. Member 26 extends integrally and diagonally from forward portion 14 of arm 12 and includes a free end 30. In a similar manner, arm 18 includes, at a forward end 20 thereof and extending diagonally therefrom, a partitioning and support member 28 having a free end 32. The arrangement is such that arms 26 and 28 converge inwardly to a point of contact at free ends 30 and 32, respectively. Ends 30 and 32 may be connected together and either connected to member 24 or slightly spaced therefrom.

As is clearly illustrated in FIG. 1, the strip provides two hollow trigonal areas, generally denoted by numerals 34 and 36, the areas being surrounded by body 10. In addition, by the arrangement of the partitioning and support members 26 and 28, there is additionally provided a third trigonal area, generally denoted by numeral 38, bounded by members 26 and 28 and having an open end.

Figure 3:
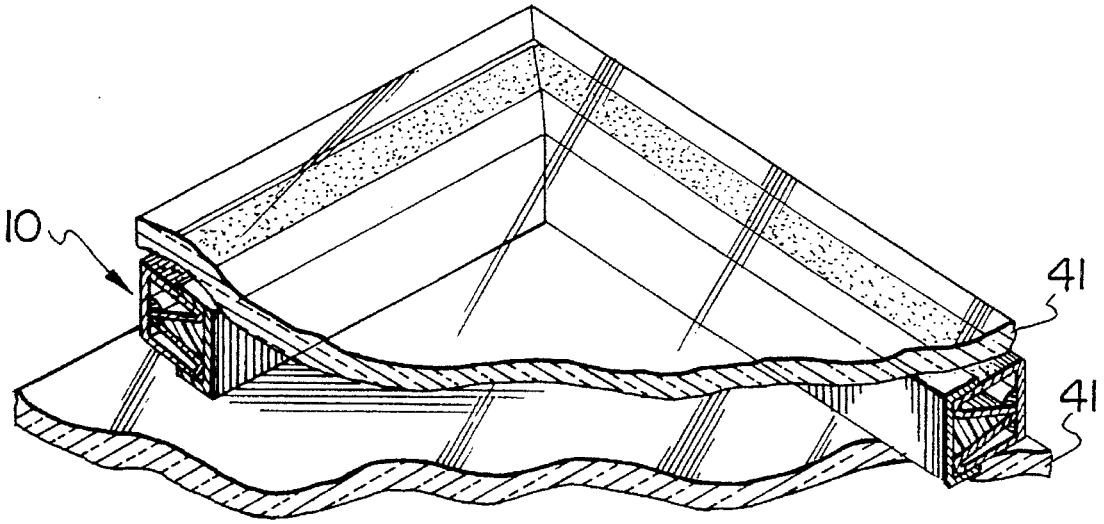
FIG. 3 is a perspective view of the spacer in position between a pair of glass substrates.

This arrangement has been found to be particularly effective when used in insulated glass assemblies, since the provision of at least two surrounded areas 34 and 36 substantially reduces the possibility of thermal bridging from an exterior substrate to an interior substrate when the strip is used in an insulated glass assembly as illustrated in FIG. 3 and discussed hereinafter in greater detail.

The strip 10 may be formed from a suitably bent plastic film or, alternatively, may be formed in an extrusion process. With respect to the materials of which the strip spacer may be made, various plastics have been found to be particularly effective when used in combination with the structural details as set forth hereinabove.

Suitable materials of which the spacer body 10 may be made include, for example, Tedlar™, Mylar™, polyvinylfluoride, polyvinylchloride, polyethylene, polyester, polypropylene, combinations thereof, reinforced versions thereof, molecularly or axially oriented films, roll-formed plastics, or other suitable resinous materials. Other suitable materials will be readily appreciated by those skilled in the art.

As a further attendant advantage to the spacer as set forth herein, a combination of the structural details, the choice of insulating materials selected from those plastics discussed herein previously, together with the fact that the body is a continuous structure, all contribute to the energy effectiveness of the spacer body.

To further complement the efficiency of the spacer 10, the areas 34 and 36 may include desiccant material in either a loose form or in a suitable carrier. Where a carrier is elected, the same may comprise, for example, suitable silicone material, polyurethane material, hot melt butyl or other suitable types of resins. It will be appreciated that the desiccants may be selected from those desiccants well known in the art such as calcium chloride, silica gel, zeolites, etc.

Figure 2:
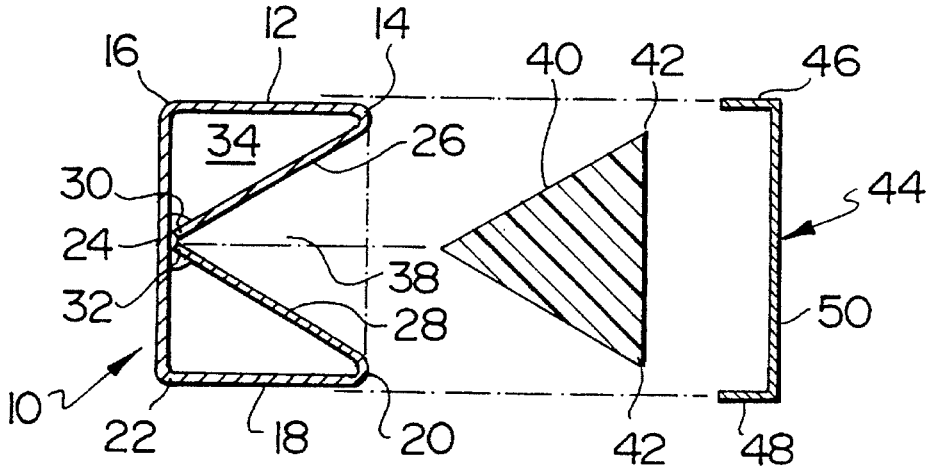
FIG. 2 is an exploded side elevational view of FIG. 1 further including ancillary features of the invention.

FIG. 2 illustrates a further embodiment according to the present invention. In this embodiment, a desiccant matrix 40, shown in a trigonal form, may be positioned within area 38. Materials for the desiccant matrix 40 may be selected from those discussed hereinabove. By incorporating desiccant matrix 40, the spacer body is given further structural integrity. The use of the desiccant matrix 40 has been found to assist in the thermal performance of the spacer. This can be seen from FIG. 3, where the spacer is positioned between two substrates 41. Due to the triangular nature of the desiccant body, points 42 are effectively in contact with the substrates. This has the advantage of limiting the contact area of the cold substrates with the desiccant body and accordingly the spacer. As such, there is reduced thermal transmission As an optional feature, the spacer 10 may include a C-shaped cap 44 illustrated in FIG. 2. Cap 44 includes two spaced apart arms 46 and 48 connected by intermediate member 50. The cap 44 may comprise materials selected for fabrication of the spacer. In addition, cap 44 may be colored to match the window framing, room interior.

Cap 44 fits over spacer body 10 and more particularly over a portion of arms 12 and 18 as illustrated in FIG. 3. The cap may be adhered to the spacer by suitable adhesives or in the alternative, may be welded by electromagnetic means well known to those skilled in the art.

Suitable adhesives, butyl material, etc., may be employed to fix the spacer 10 between substrates 41 as shown in FIG. 3. Further, butyl material (not shown) may be associated with the periphery of the assembly shown in FIG. 3.

Having described preferred embodiments of the present invention, it will be understood that various modifications or alterations can be made to the above-described embodiments without departing from the spirit and scope of the present invention.

I claim:

1. The spacer for spacing glass substrates in an insulated glass assembly, comprising:

a one-piece plastic C-shaped body including:

a base having first and second opposed sides;

an arm integrally connected at a first end to a respective side of said base, each arm having an opposed end, each said arm adapted for engaging a substrate, each said arm being in a spaced parallel relationship relative to one another from said first end to said opposed end, each arm at said opposed end including a partitioning member, said partitioning member including a free end and the partitioning members extending towards one another to converge at a point of contact on said base, said partitioning members and said arms forming a plurality of trigonal spaces within said C-shaped body.

2. The spacer as set forth in claim 1, wherein said partitioning members extend diagonally within said body.

3. The spacer as set forth in claim 2, wherein said spacer includes three trigonal spaces between said arms, two of said spaces being surrounded by said body and a third space of said spaces being open and bounded by said portioning members.

4. The spacer as set forth in claim 3, wherein said third space of said spaces includes a cover means covering an open side of said third space.

5. The spacer as set forth in claim 4, wherein said third space includes desiccant material therein.

6. An insulated glass assembly, comprising:

plastic C-shaped body including:

a base having first and second opposed sides;

an arm integrally connected at a first end to each respective side of said base, each arm having an opposed end, each arm for engaging a substrate, each arm and substrate being in a parallel relationship relative to one another from said first end to said opposed end, each arm at said opposed end and including a partitioning member, each partitioning member including a free end, the partitioning members extending inwardly to converge at a point of contact on said base, said partitioning members and said arms forming a plurality of trigonal spaces in said body.

7. The assembly as set forth in claim 6, wherein said partitioning members extend diagonally within said body.

8. The assembly as set forth in claim 7, wherein said spacer includes three trigonal spaces between said arms, two of said spaces being surrounded by said body and a third space of said spaces being open and bounded by said portioning members.

9. The assembly as set forth in claim 8, wherein said third space of said spaces includes a cover means covering an open side of said third space.

10. The assembly as set forth in claim 9, wherein said third space includes desiccant material therein.

11. The insulated glass assembly as set forth in claim 8 wherein said third space includes desiccant material dispersed therein.

* * * * *